US006740250B2

(12) United States Patent
Greiner et al.

(10) Patent No.: US 6,740,250 B2
(45) **Date of Patent: *May 25, 2004**

(54) FIRE SUPPRESSANT HAVING FOAM STABILIZER

(75) Inventors: Michael T. Greiner, Peachtree City, GA (US); Thomas G. Legare, III, Fayetteville, GA (US)

(73) Assignee: Hazard Control Technologies, Fayetteville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/904,051

(22) Filed: Jul. 13, 2001

(65) Prior Publication Data

US 2003/0010507 A1 Jan. 16, 2003

(51) Int. Cl.[7] ..... A62D 1/04; A62C 8/00; A62C 35/00

(52) U.S. Cl. ..... 252/8.05; 252/2; 252/3; 252/8; 169/46; 169/47

(58) Field of Search ..... 252/8.05, 8, 3, 252/2; 169/46, 47

(56) References Cited

U.S. PATENT DOCUMENTS 5,585,028 A * 12/1996 Berger ..... 252/2
5,676,876 A * 10/1997 Winkler, III ..... 252/3
5,945,026 A 8/1999 Thames ..... 252/8.05
6,139,775 A 10/2000 Thames ..... 210/365
6,262,128 B1 * 7/2001 Stern et al. ..... 516/10
6,527,970 B1 * 3/2003 Scogin et al. ..... 252/3

* cited by examiner

*Primary Examiner*—Joseph D. Anthony
(74) *Attorney, Agent, or Firm*—McHale & Slavin

(57) ABSTRACT

A biodegradable, non-toxic firefighting concentrate composition. The preferred compositions include a mixture of a $C_{14}$–$C_{18}$ 5 mole ethoxylated tallow amine, 2 mole ethoxylated coconut amine, and 5 mole ethoxylated coconut amine, wherein the blend is neutralized with a $C_6$ carboxylic acid; an aliquot of 33 parts is added to 3 parts of a 2 mole ethoxylated linear alcohol having 6 to 16 carbon atoms, and enough water to bring the total weight percentage to 70%. Ten to fifteen parts of sodium lauryl sulfate is added and the balance of water is added to bring the total up to 100%. The composition is also effective when mixed with glycol dimethyl ether, the incorporation of a filming protein based agent, dye, or foam forming materials. In addition, the composition is useful with soil bacteria for remediating soil contaminated with hydrocarbon fuel and for facilitating fuel dispersion and degradation within bacterial-action sewage systems.

18 Claims, No Drawings

FIRE SUPPRESSANT HAVING FOAM STABILIZER

FIELD OF THE INVENTION

The present invention relates generally to an improvement to compositions and methods for treating fuel hydrocarbons, and more particularly, to compositions having two different but functionally related end uses.

1. Background of the Invention

It has been established that fire suppression agents can be extremely beneficial in effectively quenching fires of various types and eliminating its ability to reignite (U.S. Pat. Nos. 5,945,026 and 6,139,775 to Thames.) According to these patents, the composition disclosed therein is able to be used by applying it either to surface or subsurface concentrations of hazardous or undesirable hydrocarbons, including masses of gasoline, oil and the like that are spilled on land, and which are intentionally or unintentionally disposed of in sewers, exposed to the soil or the air, or otherwise as the result of an accident of some sort. Chemical breakdown of the dispersed hydrocarbons can be accelerated by increasing the concentration of available bacteria for this purpose. In some cases, the surface active agent or "surfactant" composition itself can serve as a nutrient for the bacteria, thus enhancing its action in degrading the hydrocarbon materials.

In the past, the concept of utilizing surface active agents in water for treating fires has often been suggested. One aspect of the use of surfactants in firefighting is that such treatment can render the water "wetter," i.e., better able to penetrate into and through the surfaces of semi-solid materials. Moreover, the ability of surfactant materials to create frothing or foaming has been used in an attempt to provide a barrier at the liquid-air interface, which barrier will block oxygen from access to vapor at the liquid surface, usually the surface of a mass of burning oil or gasoline. In this connection, it is well known that, particularly in a petroleum-based fire, the combustion occurs only in the vapor phase, wherein oxygen in large quantities is readily available to the vapors originating within the liquid. In a fire, the increase in temperature accelerates the liquid vaporation and hence the rate of combustion. In many instances, surface active agents, particularly when accompanied by agitation, serve to achieve a mix of liquid water and fuel, thus rendering the fuel less volatile and less susceptible to burning.

2. Description of the Prior Art

U.S. Pat. Nos. 5,945,026 and 6,139,775, issued to Thames, the contents of which are herein incorporated by reference, relate to a biodegradable, non-toxic firefighting concentrate composition. According to the invention, the preferred compositions include 4 to 40 parts of a $C_{16}$–$C_{18}$ tertiary amine having 2–10 ethoxy or other solubilizing groups per mol, 1 to 15 parts of a carboxylic acid having 6 to 16 carbon atoms; 1 to 6 parts of a $C_6$–$C_{16}$ alcohol and 0 to 10 parts of $C_4$- and lower alcohols, and enough water to create a total of 100 parts by volume. The concentrate is usually diluted up to 100 times (v/v) with water, and is also effective when mixed with foam-forming materials. In addition, the composition is useful with soil bacteria for remediating soil contaminated with hydrocarbon fuel and for facilitating fuel dispersion and degradation within bacterial-action sewage systems. The concentrate is extremely useful in aquatic and land fires.

What is lacking in the prior art is a stable and long lasting foam to allow a longer period of safety from the potential reignition of a fire, such as a fuel-based fire. It is sometimes necessary in controlling a fire to "fence off" the perimeter, thus containing the blaze and avoiding further danger. If the area is unusually large, more time would be needed to accomplish this task. Also, a due to weather conditions, i.e. heavy winds, a more stable foam would assist in slowing down the fire's ability to spread.

SUMMARY OF THE INVENTION

The present invention relates to compositions which serve to emulsify organic fuels such as gasoline, diesel fuel, kerosene, so-called jet fuel and other liquid hydrocarbons in water, thus providing the potential for extinguishing fires and rendering masses of these materials non-flammable. Additional enhancements to the formulation are achieved via the inclusion of compatible high foam-forming constituents such as sodium lauryl sulfate, dodecyl benzene sulfonate or the like high foam producing product which functions to further the fire extinguishing potential of the composition in those applications wherein foam is desired.

In another aspect, the emulsifying ability of the materials can be effectively used to disperse concentrations of such hydrocarbon materials finding their way into soils and ground water to render the hydrocarbons water-transportable and readily subject to degradation by naturally occurring and/or synthetically prepared bacteria or other agents for degrading the hydrocarbons.

Still further, because of the wetting properties of the compositions, they can be effective as a fire extinguishing agent when the fuel is in solid form, i.e., filled natural or synthetic rubber such as is used in rubber tires or the like, and against more viscous but still flammable material such as lubricating oils and other heavy "cuts" of petroleum.

According to the invention, the inventive composition is able to be used by applying it either to surface or subsurface concentrations of hazardous or undesirable hydrocarbons, including masses of gasoline, oil and the like that are spilled on land, and which are intentionally or unintentionally disposed of in sewers, exposed to the soil or the air, or otherwise as the result of an accident of some sort. Chemical breakdown of the dispersed hydrocarbons can be accelerated by increasing the concentration of available bacteria for this purpose. In some cases, the surface active agent ("surfactant") composition itself can serve as a nutrient for the bacteria, thus enhancing its action in degrading the hydrocarbon materials.

Accordingly, it is an objective of the instant invention to provide a composition which includes surfactants and other components which are essentially non-toxic, even when used in substantial concentrations.

Another objective of the invention is to provide a composition which may be used to treat water used in dispersing petroleum and like wastes in water so as to lower the vapor pressure of such water and expose them to bacterial action.

A further objective of the invention is to provide a composition which, when added to water used to treat petroleum or other hydrocarbons, will freely adsorb hydrocarbons from the soil and convert them into waterborne materials of greatly reduced particle size, able to be degraded by naturally occurring or specially supplied or augmented bacteria.

Yet another objective of the invention is to provide a treating composition for water which is usable in a variety of emergency response situations, including petroleum firefighting, and in treating waterborne and land borne petroleum spills and the like.

Another objective is to provide a composition for treatment of petroleum which will render limited amounts of spilled petroleum compatible with sewage systems.

A further objective of the invention is to provide a composition for firefighting which includes an especially effective surfactant action and further provide a foaming action and in which the surfactant component for dispersing oil in water is compatible with a stable, high density foam.

A still further objective of the invention is to provide a method of treating petroleum to render it non-flammable and dispersible in such a way as to render it susceptible to bacterial attack.

Yet another objective of the invention is to provide a method of soil treatment or remediation wherein contaminated soil may be treated by a mix containing specially blended surfactants that are able to render petroleum oils dispersible in ground water and able to be attacked by bacteria including bacteria supplied for the purpose of soil remediation.

Another objective of the invention is to provide a chemical composition which is effective to disperse petroleum in such a way that the oil will assume extremely fine particle size and wherein the surfactant is not harmful to aquatic animal and vegetal life.

A further objective of the invention is to provide a treating composition for petroleum which includes a surfactant made from either a coco amine or an animal tallow modified by chemical treatments including ethoxylation and which further includes selected alcohols and organic carboxylic acids, rendering the mixture dispersible in water and providing a strong emulsifying action for petroleum based fuels and lubricants.

A still further objective of the invention is to provide a chemical mixture which is non-harmful to naturally occurring plant and animal life, even when applied to or mixed with petroleum products.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE PREFERRED EMBODIMENTS

Compositions in accordance with the instant invention may contain from about 4 to about 40 parts of an ethoxylated tertiary amine having 2–10 ethoxy groups per mol selected from the group consisting of a series of similar homologs or isomers of $C_{14}$–$C_{18}$ animal-based tallow amines and coconut amines, from about 1 to about 15 parts of at least one aliphatic carboxylic acid or isomer thereof having from 6 to 12 carbon atoms; about 1 to 6 parts of at least one of a $C_7$–$C_{12}$ aliphatic alcohol or homologs thereof, from 0 to 10 parts of a $C_4$ and lower alcohol or homolog thereof, from about 3 to about 10 parts of an ethoxylated amine derived from coconut oil, from about 0.5 to about 2 parts of a fatty amide type cationic surfactant, from about 0.5 to about 2 parts of an aliphatic substituted coco-amidopropyl betaine, and a preservative, and the balance being water to create a total of about 100 parts by volume.

Further enhancements to the formulations for improved use as a fire suppressant and fuel mitigation agent have been realized by combining the $C_{14}$–$C_{18}$ tallow amines and $C_{12}$–$C_{14}$ coco amines with a $C_6$–$C_9$ carboxylic acid, $C_4$–$C_{20}$ linear or ethoxylated alcohol, and a high foaming agent such as sodium lauryl sulfate or equivalent and water.

The addition of glycol ethers of either highly branched or straight chain can be added to improve the homogeneity of the solution but is not essential. It has also been found that the addition of small quantities of film producing, protein-based compounds such as xanthan gum will cause a filming between the foam/solution layer boundary. The creation of this boundary film was found to increase the foam coverage and stability with certain polar and non-polar compounds. The resultant product from the above formulation successfully emulsifies hydrocarbon fuels rendering them inflammable for several days and will also create a foaming blanket that will extinguish a hydrocarbon fire in an open pan or pit. This combination of fire suppression properties results in a single product that can emulsify fuel such that they are inflammable and unable to sustain or propogate a flame. The product will also rapidly extinguish any fire such as wood, tires, plastics, fiberglass, gasoline, diesel fuel, and jet fuel to list only a few.

EXAMPLES

Example 1

A mixture of $C_{14}$–$C_{16}$ ethoxylated tallow amine is mixed with $C_{12}$–$C_{14}$ coco amines and said mixture is neutralized with a $C_6$–$C_9$ carboxylic acid to a neutral pH. Blended into this mixture are $C_4$–$C_{20}$ ethoxylated linear alcohols and enough water added to bring the total weight percentage to 70%. Slowly with mixing sodium lauryl sulfate (or similar product such as dodecyl benzene sulfonate or any high foam producing product) is added. The end product can be blended with water to bring the total percentage to 100 or several of the branched or straight chain glycol dimethyl ethers can be added to enhance the heat capacity of the product before adding enough water to bring the total percentage to 100% by weight.

Example 2

10 parts of a $C_{14}$–$C_{16}$ 5 mole ethoxylated tallow amine is blended with 30 parts of a 2 mole ethoxylated coconut amine and 60 parts of a 5 mole ethoxylated coconut amine. This blend is neutralized to a pH of 6.5–7.5 with a $C_6$ carboxylic acid. An aliquot of 33 parts of this neutralized mixture is blended with 3 parts of a $C_6$–$C_{12}$ 2 mole ethoxylated linear alcohol. Optionally, 1–3 parts of a glycol dimethyl ether may be added to the blend to enhance the heat capacity of the product. Water is slowing added to bring the total weight percentage to 70%. Slowly 10–15 parts of sodium lauryl sulfate is added with mixing. The incorporation of a filming protein based agent can be added at this point of the blend. Several blends were made using either a mix or in singular concentration of xanthan gum and/or sodium alginate in the range of 0.05 to 2.0%. Dye can be added at this point if desired in the concentration ranges of 500 to 2,000 parts per million. Slowly the balance of water is added to the mix to bring the total to 100 percent. The resultant blend can be used at any dilution desired to mitigate fuel fires or spills. The product had a low surface tension of less than 27 dynes and a very high BTU absorption/release factor of >80,000 BTU's per gallon. It was found that several combinations of high foaming agents could be incorporated in the blend including but not limited to sulfonates of dodecyl and tridecylbenzenes, alcohols, cumene, toluene, and xylene.

The ratios of tallow amine and coco amine can be varied without reducing the functionally of the product when used to extinguish Class A, B, and D fires.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objects and obtain the ends and advantages mentioned, as well as those inherent therein. The compounds, compositions, biologically related compounds, methods, procedures and techniques described herein are presently representative of the preferred embodiments, are intended to be exemplary, and are not intended as limitations on the scope. Changes therein and other uses will occur to those skilled in the art, which are encompassed within the spirit of the invention and are defined by the scope of the appended claims.

Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. In a method of firefighting including the steps of:

preparing a biodegradable, non-toxic foamable firefighting concentrate composition comprising, by volume, from about 4 to about 40 parts of at least one alkoxylated tertiary amine having 2–10 alkoxy groups per mol selected from the group consisting of $C_{14}$–$C_{18}$ animal-based tallow amines and $C_{12}$–$C_{14}$ coconut amines, from about 1 to about 15 parts of at least one aliphatic carboxylic acid having from 6 to 12 carbon atoms; about 1 to 6 parts of at least one of a $C_7$–$C_{12}$ aliphatic alcohol, from 0 to 10 parts of a $C_4$ and lower alcohol, from about 0.5 to about 2 parts of a fatty amide type cationic surfactant, from about 0.5 to about 2 parts of an aliphatic substituted coco-amidopropyl betaine, and a preservative; and injecting said concentrate composition at high pressure into a turbulent stream of firefighting water such that said firefighting water includes up to about 6% of said concentrate composition, and directing said firefighting water toward a target to create a wetted target area covered at least in part by a blanket of stable, fire resistant foam; the improvement comprising;

combining said concentrate composition with 10–15 parts sodium lauryl sulfate and/or sodium dodecyl benzene sulfonate as a high foam producing agent, 0.05–2.0 parts xanthene gum and/or sodium alginate, 1–3 parts of one or more straight chain or branched glycol ethers, and the balance being water to create a total of 100 parts by volume;

whereby a fire fighting foam is produced which emulsifies hydrocarbons and renders them inflammable for a period of at least two days.

2. A method as defined in claim 1 wherein said alkoxylated tertiary amine is an alkoxylated tallow amine having an average of about 5 mols ethylene oxide per molecule of tallow amine.

3. A method as defined in claim 1 wherein said aliphatic carboxylic acid comprises isononanoic acid.

4. A method as defined in claim 1 wherein said aliphatic carboxylic acid includes 2-ethyl hexanoic acid.

5. A method as defined in claim 1 wherein said composition includes a biocide preservative sufficient to prevent bacterial degradation of said concentrate composition.

6. A method of firefighting in accordance with claim 1 wherein said firefighting water contains from about 0.5% up to about 6% of said concentrate composition.

7. In a firefighting foam comprising:

a biodegradable, non-toxic foamable firefighting concentrate composition comprising, by volume, from about 4 to about 40 parts of at least one alkoxylated tertiary amine having 2–10 alkoxy groups per mol selected from the group consisting of $C_{14}$–$C_{18}$ animal-based tallow amines and $C_{12}$–$C_{14}$ coconut amines, from about 1 to about 15 parts of at least one aliphatic carboxylic acid having from 6 to 12 carbon atoms; about 1 to 6 parts of at least one of a $C_7$–$C_{12}$ aliphatic alcohol, from 0 to 10 parts of a $C_4$ and lower alcohol, from about 0.5 to about 2 parts of a fatty amide type cationic surfactant, from about 0.5 to about 2 parts of an aliphatic substituted coco-amidopropyl betaine, and a preservative;

wherein said concentrate composition is injected at high pressure into a turbulent stream of firefighting water such that said firefighting water includes up to about 6% of said concentrate composition, and directing said firefighting water toward a target to create a wetted target area covered at least in part by a blanket of stable, fire resistant foam; the improvement comprising;

combining said concentrate composition with 10–15 parts sodium lauryl sulfate and/or sodium dodecyl benzene sulfonate as a high foam producing agent, 0.05–2.0 parts xanthene gum and/or sodium alginate, 1–3 parts of one or more straight chain or branched glycol ethers, and the balance being water to create a total of 100 parts by volume;

whereby a fire fighting foam is produced which emulsifies hydrocarbons and renders them inflammable for a period of at least two days.

8. The product as defined in claim 7 wherein said alkoxylated amine is an ethoxylated ether amine.

9. The product as defined in claim 7 wherein said ethoxylated amine is an ethoxylated propylene diamine.

10. The product as defined in claim 7 wherein said $C_6$–$C_{12}$ alcohol comprises a mixture of n-octanol and n-decanol.

11. The product as defined in claim 7 wherein said mixture of alcohols is from about 40% to about 60% of n-octanol and the remainder is n-decanol.

12. The product as defined in claim 7 wherein said amine material is present in an amount from about 10 to about 15 parts, said carboxylic acid being present in an amount of from about 7 to about 10 parts, said $C_7$–$C_{12}$ alcohol being present in an amount of from about 1.5 parts to about 4 parts, all based on said 100 parts by volume.

13. The product as defined in claim 7 which further includes sufficient color dye to render said water in which the firefighting composition is dispersed sufficiently visible to indicate that said firefighting concentrate is present in said water in an effective amount.

14. The product as defined in claim 13 wherein said composition includes a biocide preservative sufficient to prevent bacterial degradation of said concentrate material.

15. A biodegradable, non-toxic firefighting concentrate composition, said composition comprising, by volume, from about 4 to about 40 parts of at least one alkoxylated tertiary amine surfactant selected from the group consisting of $C_{16}$–$C_{18}$ animal-based tallow amines and $C_{12}$–$C_{14}$ coconut amines, from about 1 to about 15 parts of at least one carboxylic acid having from 4 to 16 carbon atoms; about 1 to 6 parts of at least one of a $C_4$–$C_{20}$ alcohol, from 0 to 10 parts of a $C_4$ and lower alcohol, 10–15 parts sodium lauryl sulfate and/or sodium dodecyl benzene sulfonate as a high foam producing agent, 0.05–2.0 parts xanthene gum and/or sodium alginate, 1–3 parts of one or more straight chain or branched glycol ethers, and the balance being water to create a total of 100 parts by volume;

said tertiary amine surfactant including a lipophilic portion and a hydrophilic portion rendering said amine surfactant, in the presence of said acid and said alcohol, being capable of emulsifying petroleum hydrocarbons in water, said concentrate having said emulsifying and firefighting capability when diluted with up to 100 parts of water per part of concentrate.

16. A biodegradable concentrate composition as defined in claim 15 wherein said tertiary amine surfactant is an alkoxylated $C_{16}$–$C_{18}$ tertiary amine having 2–10 alkoxy groups per mol.

17. A composition as defined in claim 16 wherein said alkoxylated amine is an ethoxylated amine.

18. In a surfactant composition for dilution with water to create a firefighting concentrate, said surfactant composition comprising about 56% of an alkoxylated $C_{12}$–$C_{18}$ tertiary amine surfactant, about 34% of a carboxylic acid having from about 4 to 16 carbon atoms and about 10% of at least one $C_4$–$C_{20}$ alcohol, said tertiary amine surfactant including a lipophilic portion and a hydrophilic portion rendering said amine surfactant, in the presence of said acid and said alcohol, capable of emulsifying petroleum hydrocarbons in water, the improvement comprising:

further including 10–15 parts sodium lauryl sulfate and/or sodium dodecyl benzene sulfonate as a high foam producing agent, 0.05–2.0 parts xanthene gum and/or sodium alginate, 1–3 parts of one or more straight chain or branched glycol ethers, and the balance being water to create a total of 100 parts by volume;

wherein said surfactant composition is dilutable with water to form a concentrate wherein said surfactant composition is present in an amount of about 15% to about 60% of said firefighting concentrate.

* * * * *